US007444766B2

(12) United States Patent
Mitchell

(10) Patent No.: US 7,444,766 B2
(45) Date of Patent: Nov. 4, 2008

(54) FOOTWEAR WITH ENHANCED CUSHIONING

(75) Inventor: David P. Mitchell, Clarksville, TN (US)

(73) Assignee: Rocky Brands Wholesale LLC, Nelsonville, OH (US)

( * ) Notice: Subject to any disclaimer, the term of this patent is extended or adjusted under 35 U.S.C. 154(b) by 107 days.

(21) Appl. No.: 10/963,885

(22) Filed: Oct. 12, 2004

(65) Prior Publication Data

US 2006/0075658 A1 Apr. 13, 2006

(51) Int. Cl.
*A43B 13/18* (2006.01)
*A43B 13/38* (2006.01)

(52) U.S. Cl. ..... 36/28; 36/30 R; 36/44

(58) Field of Classification Search ..... 36/28, 36/31, 30 R, 25 R, 43, 44, 140
See application file for complete search history.

(56) References Cited

U.S. PATENT DOCUMENTS

| | | | | |
|---|---|---|---|---|
| 2,144,330 | A | 1/1939 | Farrington | |
| 2,809,450 | A | 10/1957 | Stritler | |
| 3,601,908 | A * | 8/1971 | Gilkerson | 36/43 |
| 4,654,983 | A * | 4/1987 | Graham et al. | 36/30 R |
| 4,783,910 | A * | 11/1988 | Boys et al. | 36/107 |
| 5,105,564 | A | 4/1992 | Motoda | |
| 6,321,464 | B1 | 11/2001 | Oberg et al. | |
| 6,574,886 | B1 * | 6/2003 | Issler | 36/12 |
| 2003/0101620 | A1 * | 6/2003 | Reed et al. | 36/30 A |
| 2004/0250446 | A1 * | 12/2004 | Greene et al. | 36/25 R |
| 2006/0005428 | A1 * | 1/2006 | Lebo | 36/43 |

* cited by examiner

*Primary Examiner*—Jila M Mohandesi
(74) *Attorney, Agent, or Firm*—Porter, Wright, Morris & Arthur, LLP

(57) ABSTRACT

Footwear includes an insole of low density polyurethane and an integral border for attaching the insole to the upper and having an integral support surface for attaching a steel shank. The footwear includes the insole and two contiguous cushioning layers.

7 Claims, 8 Drawing Sheets

FIG.4
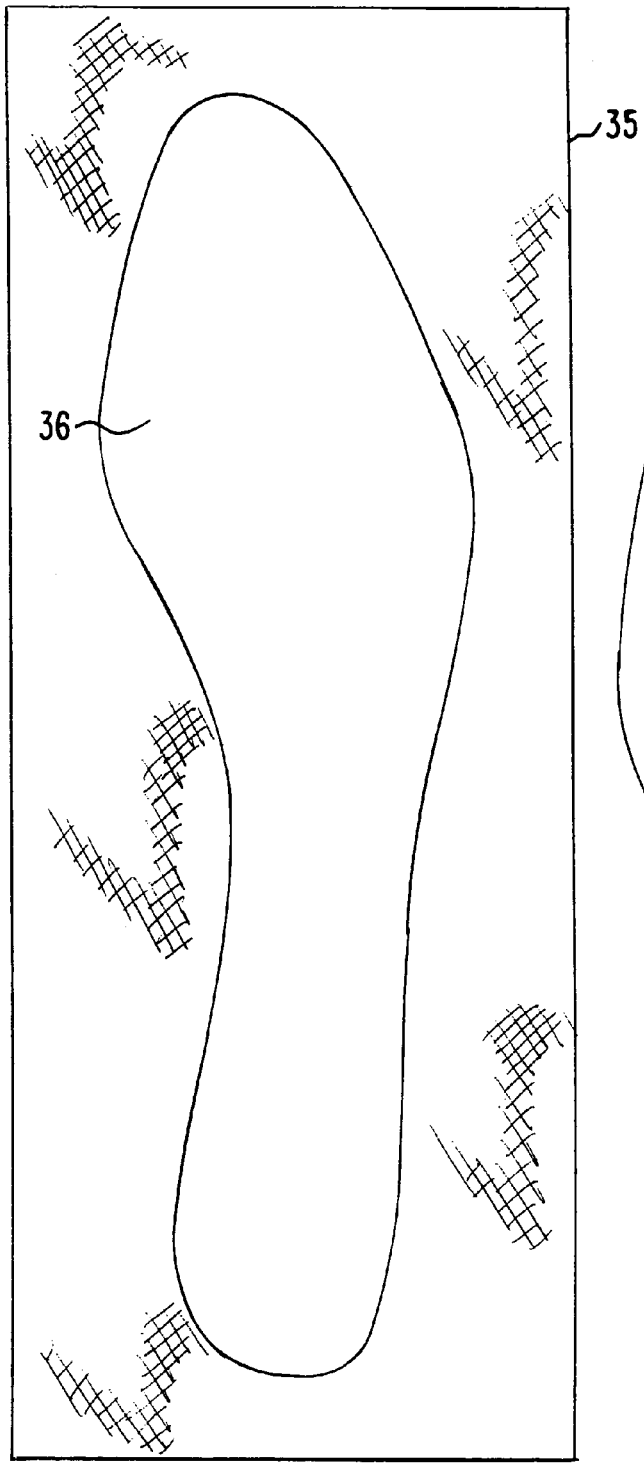
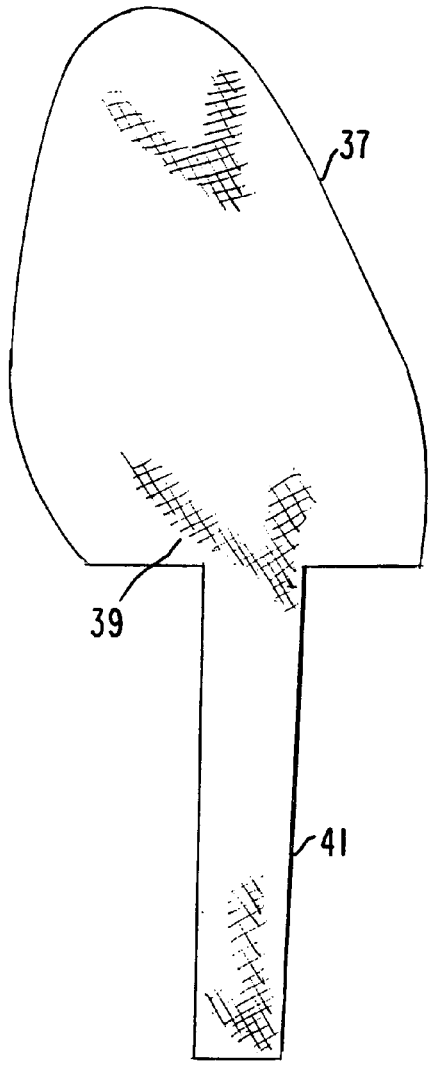
FIG.4A

FIG.6
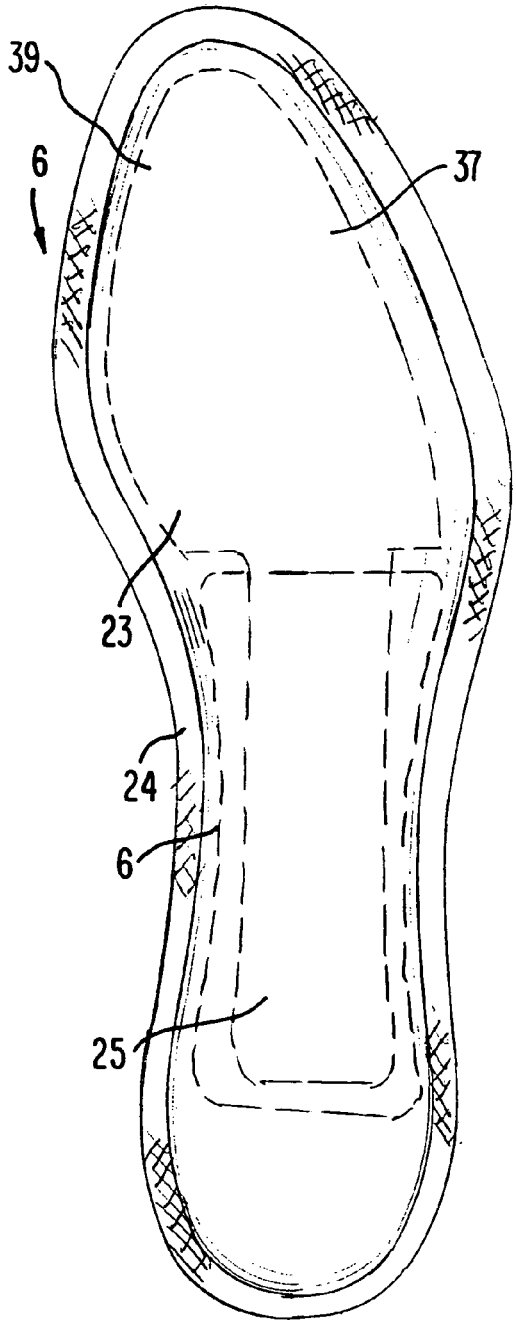
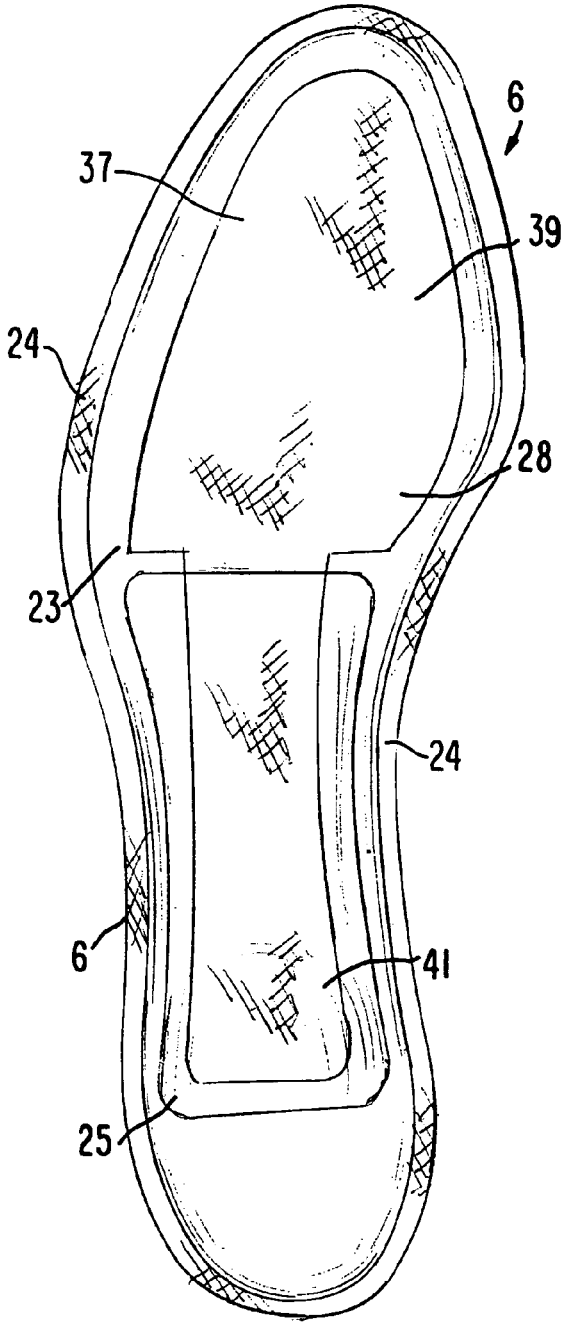
FIG. 7

FOOTWEAR WITH ENHANCED CUSHIONING

A. BACKGROUND OF THE INVENTION

1. Field of the Invention

This invention relates to footwear.

2. Description of the Prior Art

It is known in the prior art to form cushioned insoles for footwear from low density polyurethane having, for example, a specific gravity in the range of between approximately 0.35 and 0.45. The lower the specific gravity the greater is the cushioning effect of the insole. A limiting factor in the use of such low density polyurethane is that in certain footwear forming processes, such as the flat lasting process, an insole formed of low density polyurethane is not strong enough to retain the stitching between the insole and the upper when the stitches are tightened.

On the other hand, insoles formed of higher density polyurethane are not so limited because they are strong enough to retain the stitching between the insole and the upper as the stitches are tightened. However, these higher density polyurethane insoles provide less cushioning than do the lower density polyurethane insoles.

One prior art solution is to locate the low density polyurethane insole below a firmer cloth cover which is stitched to the upper. The firmer cloth cover, unlike the low density polyurethane, is strong enough to retain the force of the stitching when the stitches are tightened. However, because the wearer's foot is on the harder cloth cover, the cushioning effect of the underlying low density polyurethane insole is substantially diminished.

B. SUMMARY OF THE INVENTION

An insole formed of low density polyurethane having a specific gravity of between 0.35 and 0.45 includes an integral border of harder material. The harder border is stitched to the upper so that the insole is connected to the upper without having to stitch the low density polyurethane to the upper. It will be appreciated that the stitches will not be torn from the harder border, when the stitches are tightened during the flat lasting process. Further, because the border extends only around the periphery of the low density polyurethane, the wearer receives the virtually undiminished cushioning effect of the low density polyurethane.

The low density polyurethane insole can be used with contiguous cushioning layers such as a polyurethane cushioned insert and a polyurethane midsole to enhance the cushioning effect. In a preferred embodiment, the polyurethane cushioned insert, whose upper surface is contoured to receive the wearer's heel, overlies the insole. The polyurethane of the cushioned insert is of lower density than the polyurethane which forms the insole and therefore provides a greater cushioning effect than does the polyurethane of the insole. In addition, the molded polyurethane midsole, which is of higher density than the polyurethane insole, is molded to the underside of the insole and to the top of an outsole. The use of a polyurethane cushioned insert, a separate polyurethane insole and a separate polyurethane midsole, all of different densities enables the shoe designer to vary the densities of these members to produce footwear of varying cushioning characteristics.

The insole of the preferred embodiment includes an integral support section at the bottom for the purpose of stabilizing the polyurethane from stress during the shoe forming process. A fiberboard shank stabilizer is located at the bottom of the insole to stabilize a steel shank mounted on the underside of the fiberboard stabilizer.

Accordingly, it is an object of this invention to provide footwear having an insole formed of low density polyurethane with an integral border of firmer material than the polyurethane for stitching the insole to an upper;

It is a further object of this invention to provide footwear having contiguous polyurethane layers of varying densities;

It is a still further object of this invention to provide footwear having an insole formed of low density polyurethane with an integral support section at the bottom thereof.

Other objects and attendant advantages of this invention will be readily appreciated as the same becomes more clearly understood by references to the following detailed description when considered in connection with the accompanying drawings in which like reference numerals designate like parts throughout the figures thereof.

C. BRIEF DESCRIPTION OF THE DRAWINGS

For a fuller understanding of the nature and objects of this invention, reference should be had to the following detailed description taken in connection with the accompanying drawings forming a part of this specification and in which similar numerals of reference indicate corresponding parts in all the figures of the drawings.

FIG. 4 is a top plan view of the material from which the border of the insole is formed;

FIG. 4A is a top plan view of the material from which the support section of the insole is formed;

FIG. 6 is a top view of the insole;

FIG. 7 is a bottom view of the insole; and

D. DESCRIPTION OF THE PREFERRED EMBODIMENT

Figure 1:
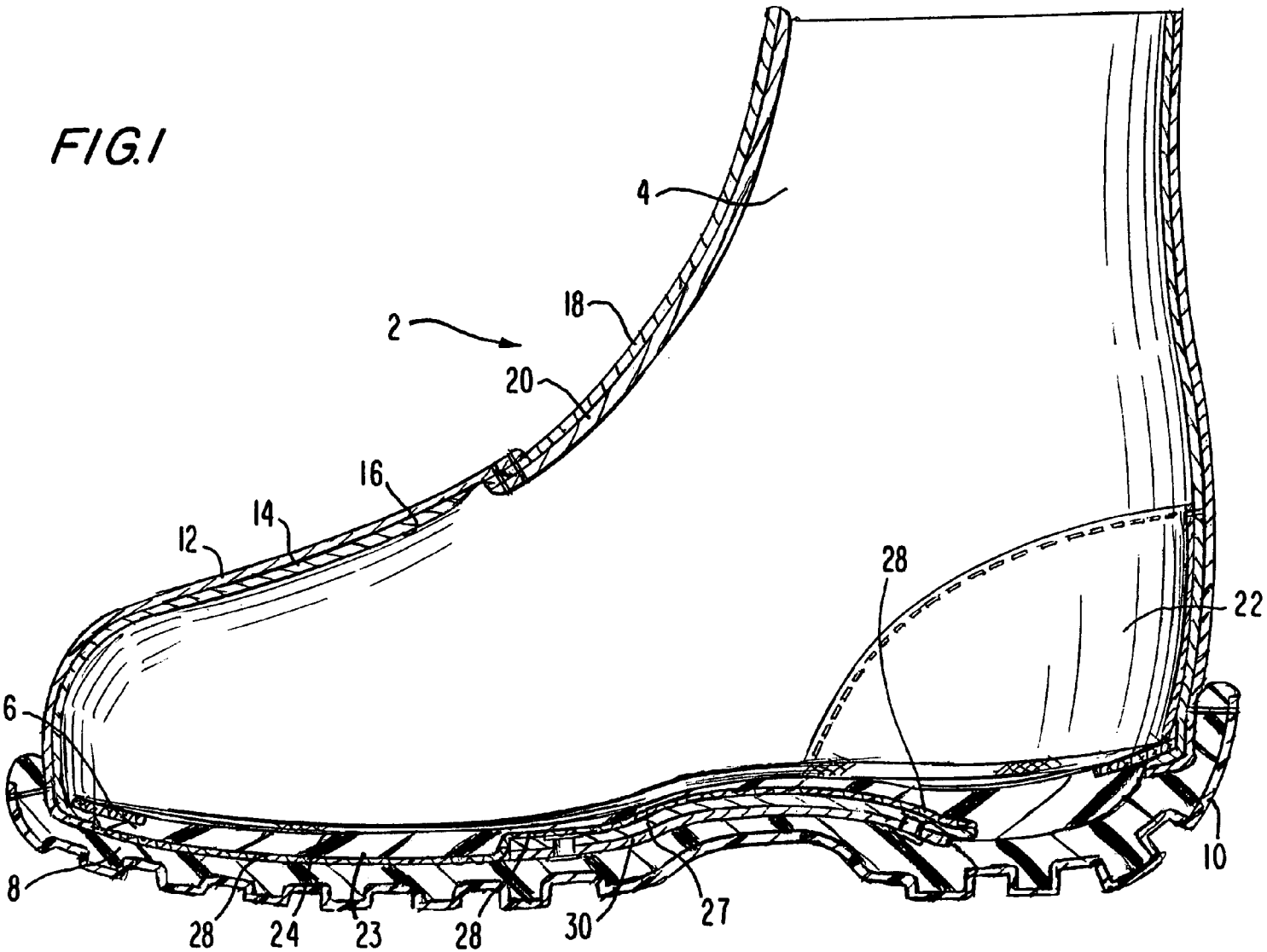
FIG. 1 is a sectional side elevational view of the footwear of the present invention without the cushioned insert.

With reference to FIG. 1, there is shown footwear 2 which comprises an upper 4, an insole 6, a midsole 8 and an outsole 10. Upper 4 is a conventional upper and comprises a leather outer layer 12, box toe 14 and a lining 16. Upper 4 also includes tongue 18 and cushioning material 20 attached to the underside of tongue 18. A conventional heel stiffener 22 is stitched to lining 16.

Figure 8:
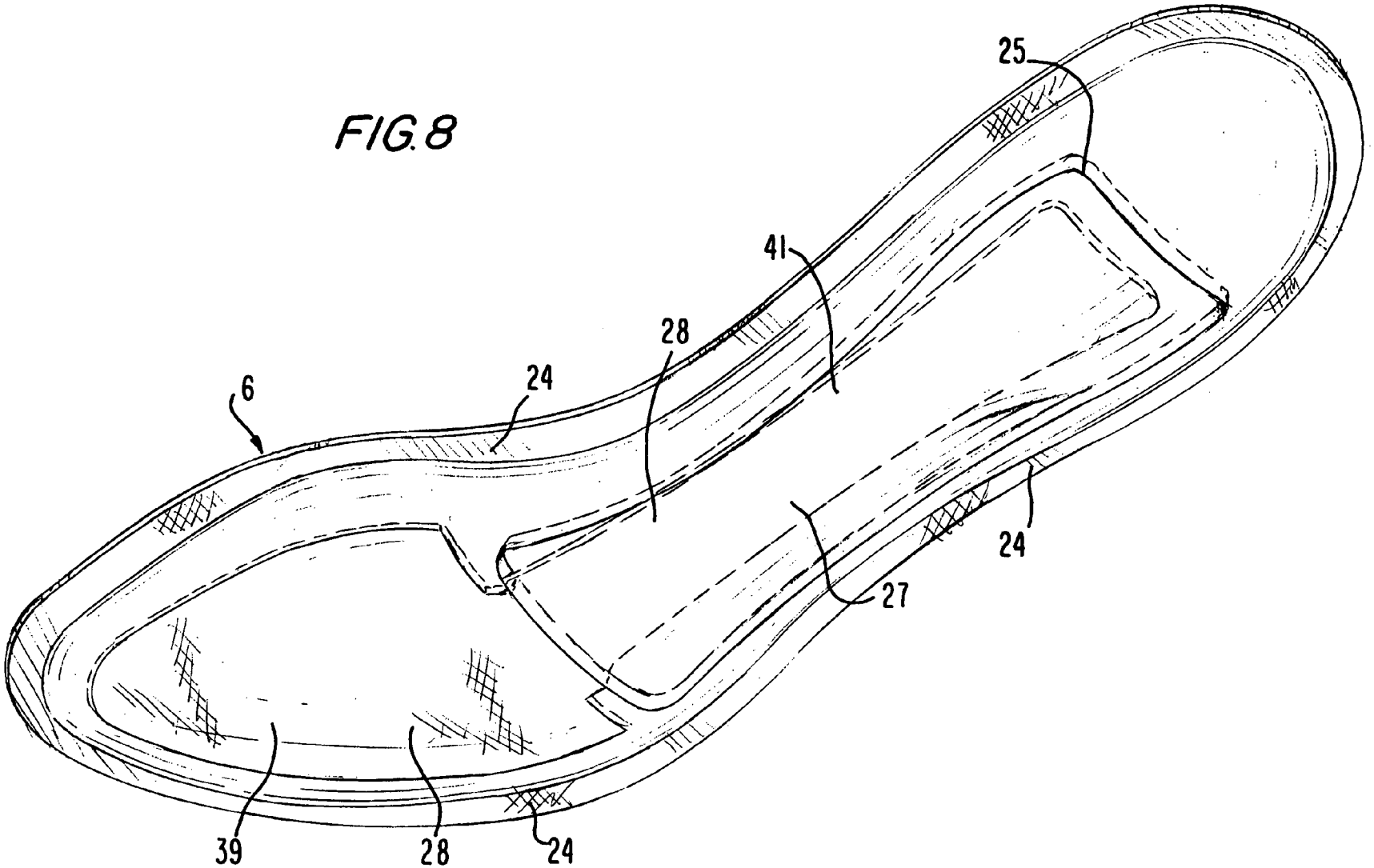
FIG. 8 is a bottom perspective view of the insole including the fiberboard stabilizer.

Insole 6 is formed of low density polyurethane 23, which may have a specific gravity in the range of between 0.35 and 0.45 and an integral border 24 molded to the low density polyurethane 23 (see FIGS. 6, 7 and 8). Border 24 which may be formed of non-woven and canvas cloth is a firmer and stronger material than the low density polyurethane 24 and is attached to upper 4 by, for example, zigzag stitching. A conventional strobel stitching machine may be used to stitch the border 24 to upper 4.

Figure 1A:
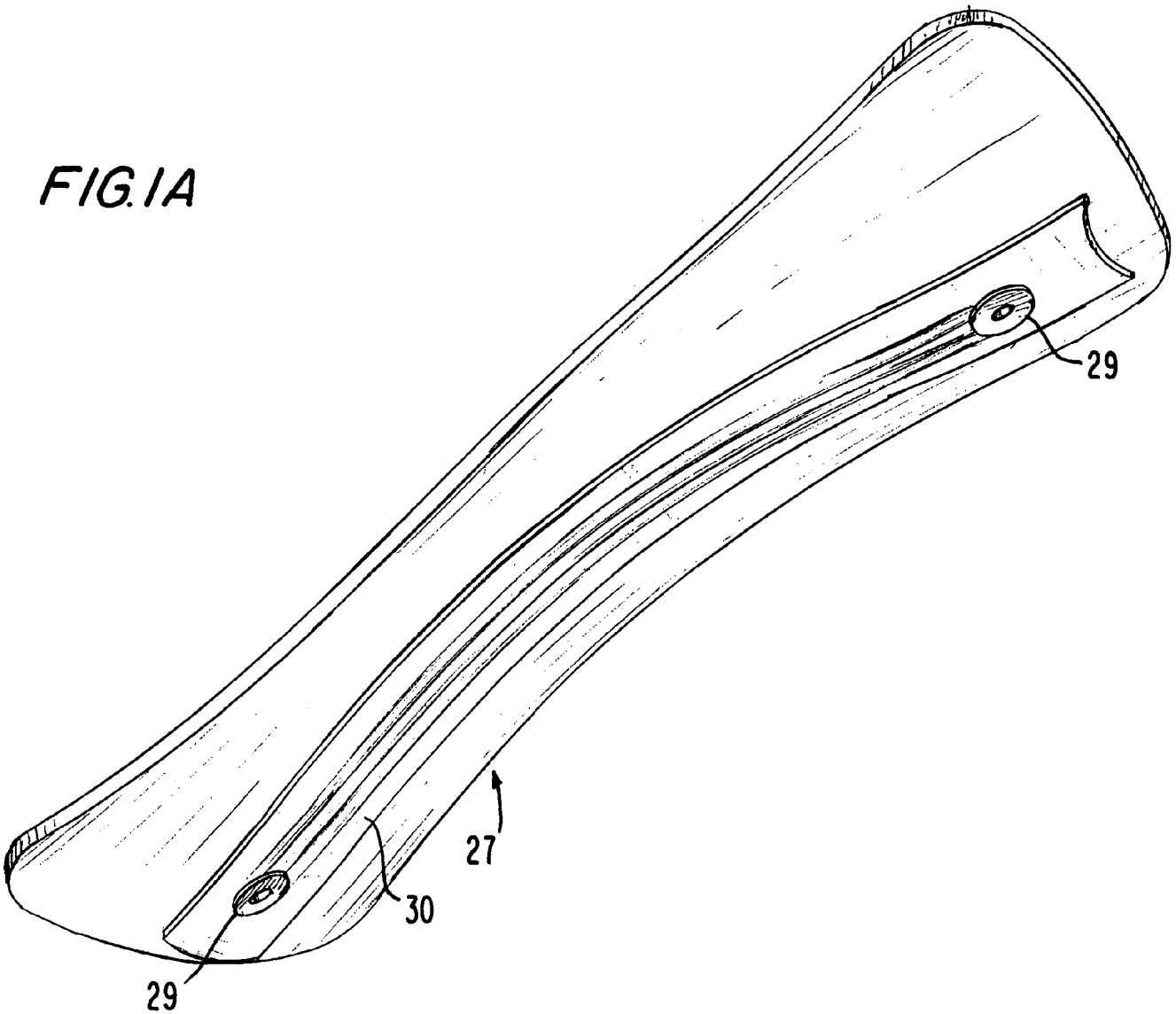
FIG. 1A is a perspective view of the fiberboard stabilizer located on the bottom of the insole and showing the steel shank mounted thereon.

An integral support surface 28 which is of the same material as border 24 is molded to the bottom of insole 6 for the purpose of stabilizing the polyurethane from stress during the shoe forming process. The bottom of insole 6 has a shaped opening 25 to receive a fiberboard shank stabilizer 27 whose top may be cemented in opening 25. A conventional steel shank 30 is mounted on the underside of fiberboard shank stabilizer 27 by rivets 29 (see FIG. 1A).

Midsole 8, molded to the bottom of the insole 6, is also formed of polyurethane but this polyurethane, which may have a specific gravity in the range of between 0.45 and 0.65, is substantially firmer than the low density polyurethane 23 of insole 6 and therefore has less cushioning effect than the low density polyurethane 23. Outsole 10 is formed of conventional thermoplastic urethane that is injected into a mold under pressure.

Figure 2:
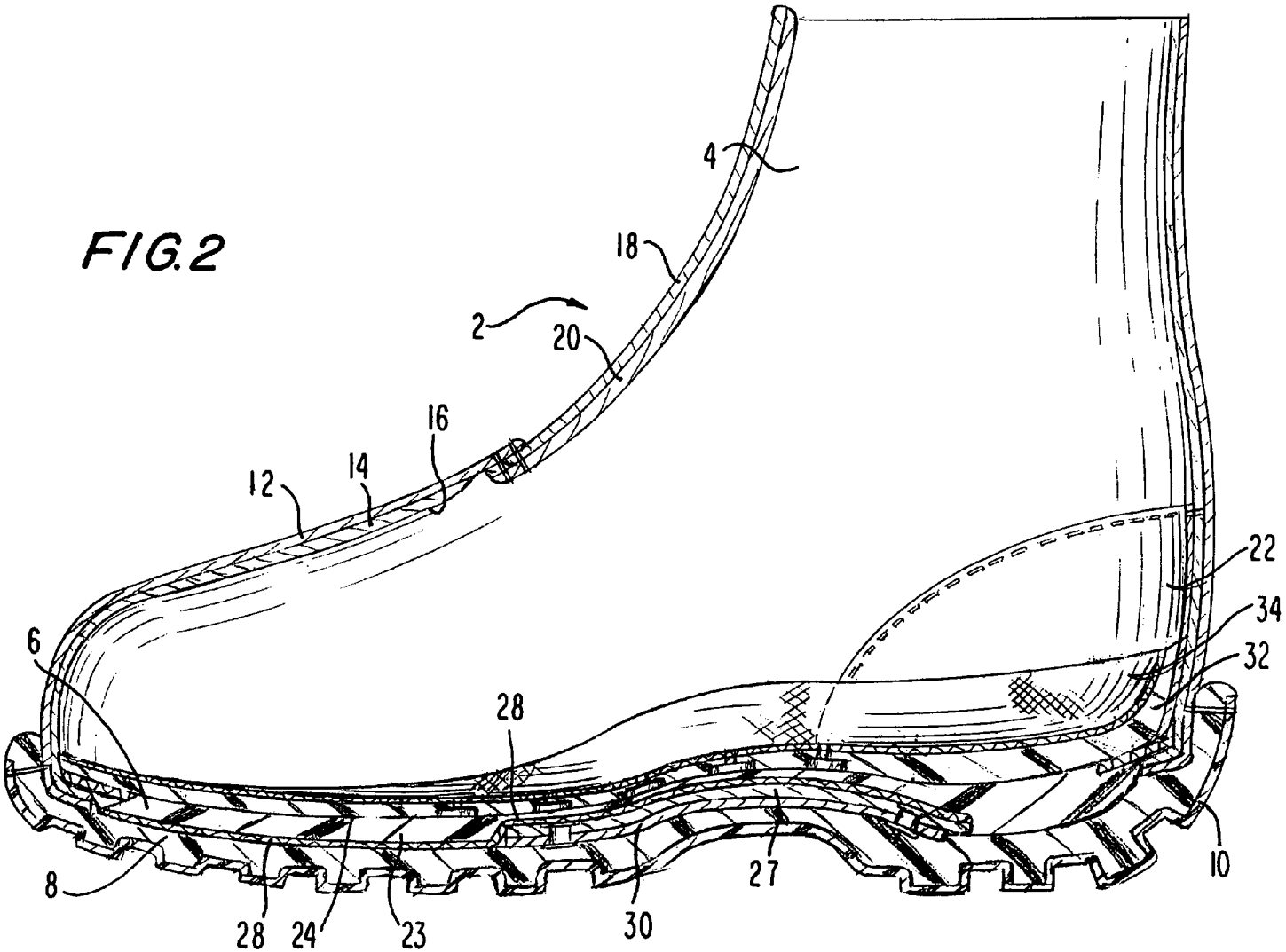
FIG. 2 is a sectional side elevational view of the footwear of the present invention with the cushioned footwear.
Figure 3:
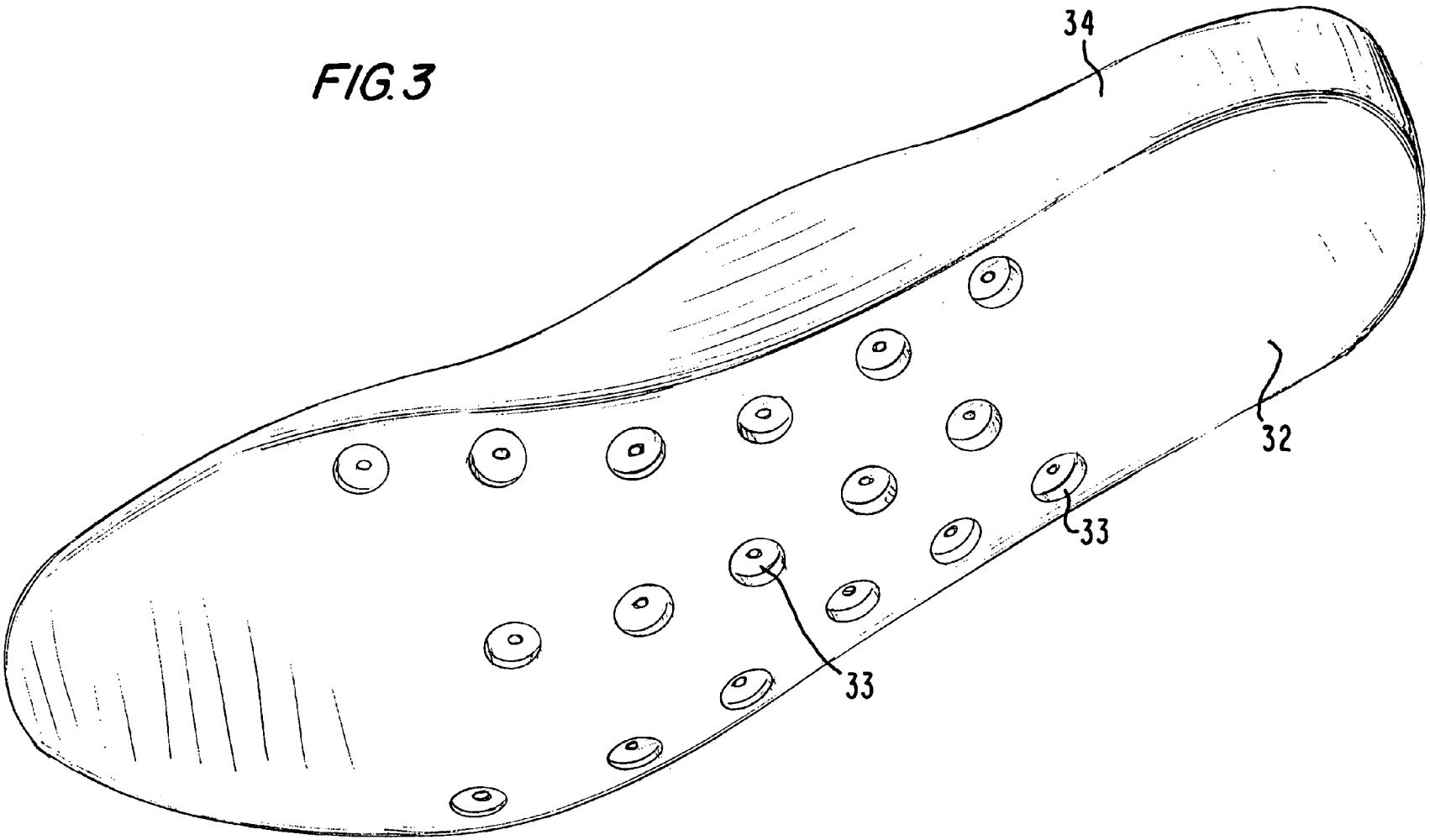
FIG. 3 is a perspective view of the cushioned insert.

FIG. 2 is a sectional side elevational view of the footwear shown in FIG. 1 and includes cushioned insert 32 which overlies insole 6. Cushioned insert 32 is of the type disclosed in U.S. Pat. No. 6,321,464 and includes a contoured heel receiving portion 34. Cushioned insert 32 may have a specific gravity in the range of between 0.40 and 0.45 and is formed of polyurethane which is less dense than the polyurethane 23 from which insole 6 is formed and thus provides more cushioning than does the insole 6. Cushioned insert 32 may include opening 33 to permit circulation of air.

To produce insole 6, a non-woven and canvas cloth 35 is formed with an opening 36 in the shape of the insole to be formed (see FIG. 4). The cloth 35 may be formed of any insole material which is capable of being strobel stitched to the upper 4. For example, the cloth 35 may include a top layer of canvas and a bottom layer of non-woven nylon fibers such as sold by Kintex International Co., Ltd. of Guangzhou, Peoples Republic of China. The top layer of canvas may be D3 insole lining consisting of a 0.5 mm layer of "Dacron" woven fabric and the bottom layer may be a 1.0 mm layer of non-woven material The opening 36 may be formed by die-cutting. The segment 37 which has been removed from cloth 35 to form opening 36 is shaped to have a front section 39 generally corresponding to the shape of the insole forepart to be formed, and also a narrow rearwardly extending section 41 (see FIG. 4A). It is the segment 37 which, after the next described molding process, provides support surface 28. The purpose of rearwardly extending section 41 is to provide additional support for the shank 30.

Figure 5:
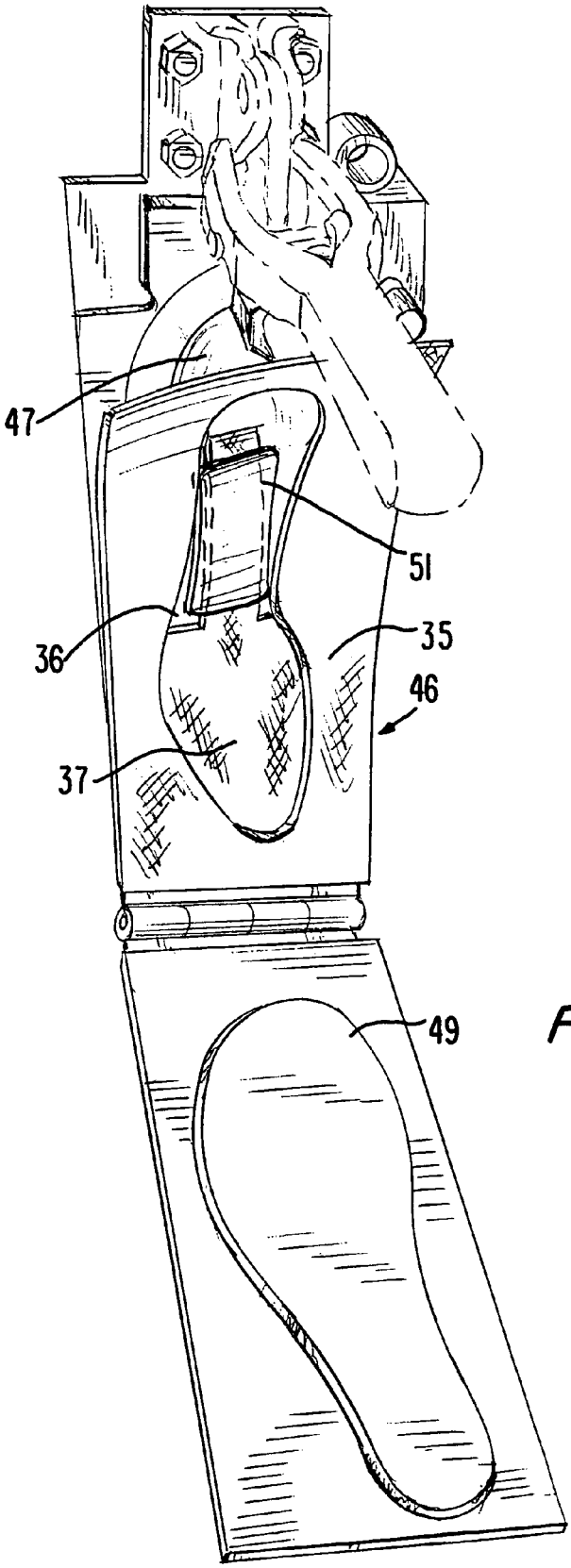
FIG. 5 is a perspective view of a mold which is used to produce the insole.

The segment 37 is placed in the bottom of cavity 47 of a mold 46 (see FIG. 5). Cavity 47 includes a raised portion 51 which forms the shaped opening 25 in the bottom of insole 6 that receives fiberboard stabilizer 27. The mold 46 also includes cavity 49 which forms the top of insole 6.

The cloth 35 having the opening 36 thereon is shown in FIG. 5 as being placed around cavity 47 of mold 46. Polyurethane 23 is then poured into cavity 47 and the mold is closed. The polyurethane 23 then expands to fill cavity 47 and 49 in known manner. As a result of the foregoing molding process, the insole 6 is formed with the cloth 35 forming a border around polyurethane 23. Also as a result of the molding process, segment 37 forms support surface 28 at the bottom of polyurethane 23. The cloth 35 is then trimmed to provide the integral border 24.

The completed insole 6 including border 25 formed from cloth 35 is shown in FIG. 8. Insole 6 includes shaped opening 25 which was formed by raised portion 51 in cavity 47. The top of fiberboard stabilizer 27 is cemented in the opening 25 (see FIG. 8) and a conventional steel shank is mounted on the underside of fiberboard stabilizer 27 by rivets 29.

The integral border 24 of insole 6 is stitched by zigzag stitching to the lower edge of upper 4. A conventional last is inserted into the upper 4 and the front of the footwear is flat lasted in known manner. It is seen that the front portion of the footwear that is lasted in FIG. 1 extends beneath the front of insole 6. It is found desirable to flat last the front portion of the footwear so that the footwear may accommodate a steel toe.

Outsole 10 is formed injecting thermoplastic urethane into a mold. The mold for forming outsole 10 comprises an upper mold and a lower mold having cavities which form the shape of outsole 10. After the outsole 10 is formed in conventional manner, the upper mold is removed and the shoe upper 4 with the insole 6 thereon is placed above the outsole 10 at a height corresponding to the height of the midsole 8 to be formed.

A conventional mold comprising side rings for forming midsole 8 are brought together between the shoe upper 4, with the insole 6 thereon, and the outsole 10. A liquid polyurethane is inserted through an opening in the rings to form midsole 8 having a specific gravity of, for example, 0.45. The rings for forming insole 8 are then moved apart and the footwear is removed from the lower mold which formed outsole 10. The cushioned insert 32 is then inserted in the footwear as shown in FIG. 2.

It will be appreciated that by selecting different densities of polyurethane for the different cushioning layers, it is possible to provide wide variations in the overall cushioning effect of the footwear.

This invention has been described above with reference to presently preferred embodiments of the invention; such description has not been presented as a catalog exhaustive of all forms which this invention may take. Accordingly, workers skilled in the art to which this invention pertains will readily appreciate that variations, alterations or modifications in the structures, procedures and arrangements described above may be practiced without departing from the scope of this invention. Thus, the foregoing description should not be read as limiting the scope of this invention to less than the fair scope of the invention.

I claim:

1. A method of producing an insole for footwear comprising the steps of:

a. providing a non-woven cloth material having an opening therein in the shape of the insole to be formed;

b. inserting the cloth material in a mold;

c. placing polyurethane in the opening in said non-woven cloth material; and d. molding the polyurethane and non-woven cloth material to form an insole so that the non-woven cloth material provides a border around the polyurethane.

2. A method of producing an insole for footwear as recited in claim 1 wherein the polyurethane has a specific gravity of between 0.35 and 0.45.

3. A method of producing an insole for footwear as recited in claim 1 including the further steps of providing the same non-woven material in the bottom of said mold and molding the polyurethane and said same non-woven material to form a support surface.

4. A method of producing an insole for footwear, comprising the steps of:

providing a non-woven fabric having an opening therein corresponding to the shape of the insole to be formed;

inserting the non-woven fabric in a mold;

placing a polyurethane material in the opening in the non-woven fabric; and molding the polyurethane and the non-woven fabric to form an insole having a non-woven material border.

5. The method of producing an insole for footwear recited in claim 4, wherein the molded polyurethane has a specific gravity between 0.35 and 0.45.

6. The method of producing an insole for footwear recited in claim 4, further comprising the steps of:

placing a shaped piece of the same material as the border in the bottom of the mold; and molding the shaped piece to the polyurethane to form a support surface under the polyurethane.

7. The method of producing an insole for footwear recited in claim 6, wherein the shaped piece corresponds to the opening in the non-woven fabric.

* * * * *